8-107 SR
FIP8309 XR 4,166,718

United States Patent [19] [11] 4,166,718
Reinert et al. [45] Sep. 4, 1979

[54] PROCESS FOR BLEACHING TEXTILES

[75] Inventors: Gerhard Reinert, Allschwil; Gerd Holzle, Liestal; Andre Pugin, Riehen, all of Switzerland

[73] Assignee: Ciba-Geigy Corporation, Ardsley, N.Y.

[21] Appl. No.: 888,593

[22] Filed: Mar. 20, 1978

[30] Foreign Application Priority Data

Mar. 25, 1977 [CH] Switzerland ..... 3810/77

[51] Int. Cl.[2] ..... D06L 3/02
[52] U.S. Cl. ..... 8/111; 8/1 XA; 8/103; 8/107; 252/95; 252/99
[58] Field of Search ..... 8/111, 107, 103; 252/95, 99

[56] References Cited

U.S. PATENT DOCUMENTS

| | | | |
|---|---|---|---|
| 3,927,967 | 12/1975 | Speakman | 8/103 |
| 3,969,387 | 7/1976 | Merkl | 252/95 |
| 4,033,718 | 7/1977 | Holcombe et al. | 8/103 |
| 4,094,806 | 6/1978 | Wiers | 8/111 |
| 4,094,806 | 6/1978 | Wiers | 252/102 |

FOREIGN PATENT DOCUMENTS

| | | |
|---|---|---|
| 840348 | 10/1976 | Belgium . |
| 1372035 | 10/1974 | United Kingdom . |
| 1,408,144 | 10/1975 | United Kingdom . |

*Primary Examiner*—A. Lionel Clingman
*Attorney, Agent, or Firm*—Edward McC. Roberts

[57] ABSTRACT

A process for bleaching textiles which comprises treating stained textiles in an aqueous bath containing at least one water-soluble aluminium phthalocyanine, under irradiation with light and in the presence of oxygen, while either irradiating the bleaching bath direct or subsequently irradiating the moist textiles outside the bath, as well as water-soluble aluminium phthalocyanines containing detergent compositions are described.

22 Claims, No Drawings

PROCESS FOR BLEACHING TEXTILES

The present invention relates to a process for bleaching textiles, in particular for bleaching textiles in a washing process, as well as to detergent and bleaching compositions for carrying out said process.

In conventional household laundry processes for white goods, such as bed linen, table linen and white cotton goods, the articles are subjected to a combined washing and bleaching process in which the articles are treated in an aqueous bath containing an organic detergent and a bleaching agent. Other conventional detergent aids, such as alkaline builders, for example sodium tripolyphosphate, soil suspending agents, for example carboxymethyl cellulose, and fluorescent brightening agents, may also be present. The bleaching agent is usually a "per" compound which releases oxygen at the wash temperature. Sodium perborate is the substance normally used for this purpose. In many cases, the bleaching (i.e., stain-removing) procedure can be carried out as a separate step using a compound which liberates chlorine, such as sodium hypochlorite, or N-chloro organic compounds, such as dichlorocyanuric acid or its salts, or trichlorocyanuric acid.

These strain removal processes, however, result in varying degrees of degradation of the textile fibres. In addition, it is necessary to apply specific temperatures in order to obtain useful effects, for example temperatures in excess of 75° C. when using sodium perborate.

Another process for removing stains from textiles is known from U.S. Pat. No. 3,927,967 and is based on an oxidation reaction which is photoactivated by sulphonated zinc phthalocyanine.

The surprising discovery has now been made that stains can also be removed from textiles by using, instead of sulphonated zinc phthalocyanine, ecologically more advantageous water-soluble aluminium phthalocyanines and that with these latter compounds an even more advantageous stain-removing effect is attained.

The process of the present invention for removing stains from textiles with photoactivating compounds comprises treating stained textiles in an aqueous bath containing at least one photoactivator selected from the class of the water-soluble aluminium phthalocyanines, under irradiation with visible and/or infra-red light and in the presence of oxygen, while either irradiating the bleaching bath direct or subsequently irradiating the moist textiles outside the bath.

The necessary water-solubility of the aluminium phthalocyanines suitable for use as photoactivators in the process of the present invention can be brought about by a wide variety of water-solubilising substituents. Such substituents are known from the literature relating to phthalocyanine dyes, especially copper and nickel phthalocyanine complexes. The water-solubility of an aluminium phthalocyanine derivative is sufficient when enough of it goes into solution in order to effect a photodynamic catalysed oxidation on the fibre. A minimum solubility of as little as 0.01 g/l can be sufficient; but in general a solubility of 0.1 to 20 g/l is advantageous. A number of possible water-solubilising groups are listed hereinafter, although this enumeration makes no claim to be exhaustive. Sulpho and carboxyl groups and the salts thereof as well as groups of the formulae

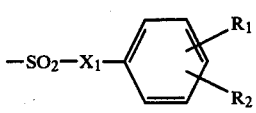
(1),

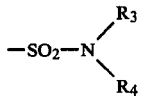
(1a),

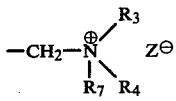
(1b),

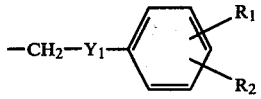
(2),

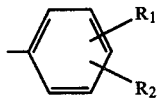
(3), $-SO_2(CH_2)_n-OSO_3M$ (4), $-SO_2(CH_2)_n-SO_3M$ (4a),

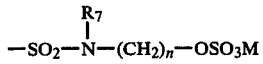
(5),

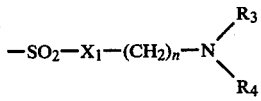
(6),

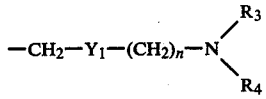
(7),

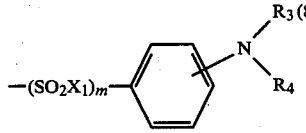
(8),

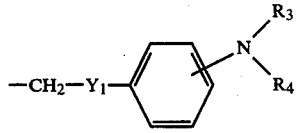
(9),

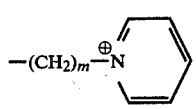
(10),

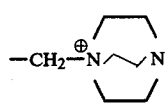
(10a), $Cl^{\ominus}$ $Cl^{\ominus}$

-continued

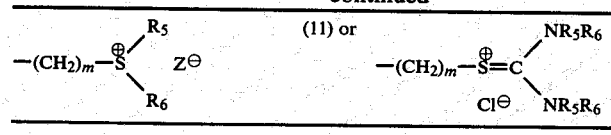

(11) or (12), wherein $X_1$ represents oxygen, the radical —NH— or —N-alkyl, and $R_1$ and $R_2$, each independently of the other, represent hydrogen, the sulpho group and the salts thereof, the carboxyl group and the salts thereof or the hydroxyl group, whilst at least one of the symbols $R_1$ and $R_2$ represents a sulpho or carboxyl group or the salts thereof, $Y_1$ represents oxygen, sulphur, the radical —NH or —N-alkyl, $R_3$ and $R_4$, each independently of the other, represent hydrogen, alkyl, hydroxyalkyl, cyanoalkyl, sulphoalkyl, carboxyalkyl or halogenalkyl each containing 1 to 6 carbon atoms, phenyl which is unsubstituted or substituted by halogen, alkyl or alkoxy of 1 to 4 carbon atoms, sulpho or carboxyl, or $R^3$ and $R^4$ together with the nitrogen atom to which they are attached form a saturated 5- or 6-membered heterocyclic ring which can additionally contain a further nitrogen or oxygen atom as ring member, $R^5$ and $R^6$, each independently of the other, represent a substituted or unsubstituted alkyl or aralkyl radical, $R_7$ represents a substituted or unsubstituted alkyl group of 1 to 6 carbon atoms or hydrogen, M represents an alkali metal or ammonium ion, $Z^{\ominus}$ represents an anion, for example a chlorine, bromine, alkyl or arylsulphate ion, n is an integer from 2 to 12, and m is 0 or 1.

In the above formulae, $X_1$ and $Y_1$ preferably represent —NH— or —N-alkyl. Halogen preferably represents chlorine or bromine, especially chlorine. Preferred 5- or 6-membered heterocyclic rings ($R_3+R^4$) are the morpholine, piperidine, pyrazoline, piperazine and oxazolidine radical.

The number of substituents present in the molecule is determined by a sufficient water-solubility being attained. If several water-solubilising groups are present in the molecule, these can be the same or different. As is customary in phthalocyanine chemistry, the degree of substitution need not absolutely be a whole number, because products which are not always homogeneous result from the method of manufacture, for example sulphonation.

In addition to the water-solubilising groups, the aluminium phthalocyanines suitable for use in the present invention can also contain other substituents, for example reactive radicals customary in colour chemistry, such as chloropyrazine, chloropyrimidine and, in particular, chlorotriazine radicals.

The process of the invention can be carried out especially advantageously by using as photoactivator a water-soluble aluminium phthalocyanine of the formula $$AlX(PC)—(R)_v \quad (13)$$

wherein

PC—represents the phthalocyanine ring system, v—has any value between 1 and 4,

X—represents an anion, preferably a halide, sulphate, nitrate, acetate or hydroxyl ion, and R—represents a group of the formula

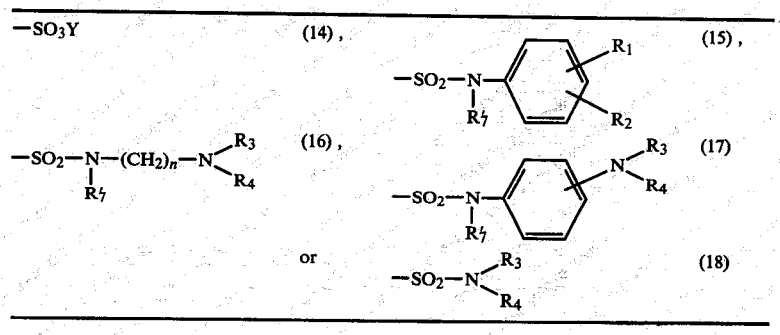

wherein

Y—represents hydrogen, an alkali metal, ammonium or amine ion, $R_7'$—represents hydrogen or alkyl of 1 to 4 carbon atoms, n'—is an integer from 2 to 6, $R_1$ and $R_2$, each independently of the other, represent hydrogen, the sulpho group and the salts thereof, the carboxyl group and the salts thereof, whilst at least one of the symbols $R_1$ and $R_2$ represents a sulpho or carboxyl group or the salts thereof, and $R_3$ and $R_4$, each independently of the other, represent hydrogen, alkyl, hydroxyalkyl, cyanoalkyl, sulphoalkyl, carboxyalkyl or halogenalkyl, each containing 1 to 6 carbon atoms, or phenyl, or $R_3$ and $R_4$ together with the nitrogen atom to which they are attached form a saturated 5- or 6-membered heterocyclic ring which additionally can also contain a further nitrogen or oxygen atom as ring member, with the proviso that, if several radicals R are present in the molecule, these radicals can be identical or different, and that all radicals R are bonded to the phenyl nuclei of the phthalocyanine ring system.

The nature of the anion X is of no importance for the action of the aluminium phthalocyanines. The purpose of this anion is solely to saturate the third valency of the aluminium ion and is normally identical with the anion of the aluminium compound which has been used for the preparation of the complex.

Very effective removal of stains is obtained by the process of the present invention by using water-soluble aluminium phthalocyanine compounds of the formula

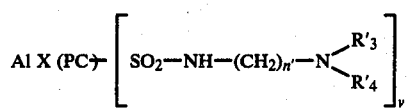

(19)

wherein

PC and X are as defined in formula (13), n' is an integer between 2 and 6, $R_3'$ and $R_4'$, each independently of the other, represent hydrogen, alkyl, hydroxyalkyl, cyanoalkyl or halogenalkyl, each containing 1 to 6 carbon atoms, and v is an integer between 1 and 4, with the priviso that, if v is greater than 1, the radicals

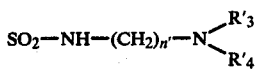

present in the molecule can be the same or different, or by using those of the formula

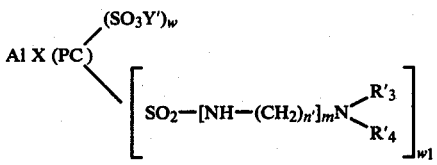

(20)

wherein

PC and X are as defined in formula (13),

Y'—represents hydrogen, an alkali metal or ammonium ion, n'—is an integer between 2 and 6, $R_3'$ and $R_4'$, each independently of the other, represent hydrogen, phenyl, sulphophenyl, carboxyphenyl, alkyl, hydroxyalkyl, cyanoalkyl, sulphoalkyl, carboxyalkyl or halogenalkyl, each alkyl radical containing 1 to 6 carbon atoms, or $R_3'$ and $R_4'$ together with the nitrogen atom to which they are attached form the morpholine ring, m—is 0 or 1, and w and $w_1$, each independently of the other, is any number between 0.5 and 3, whilst $w+w_1$ is at least 1, but not more than 4.

Particularly preferred photoactivators for use in the process of the present invention are sulphonated aluminium phthalocyanines, especially those of the formula $$AlX(PC)(SO_3Y')_{v'} \quad (21)$$

wherein

PC—represents the phthalocyanine ring system,

X—represents an anion, especially a halide, sulphate, hydroxyl or acetate ion,

Y'—represents hydrogen, an alkali metal or ammonium ion, and v'—represents any number between 1.3 and 4 (degree of sulphonation).

Particularly good results are obtained with those compounds of the formula (21) in which the degree of sulphonation v' is 1.5 to 2.5, as these compounds exhaust very well onto the fibres. Compounds having degrees of sulphonation of 2.5 to 4 also have good bleaching action.

As stated at the outset, the water-soluble, especially sulphonated, aluminium phthalocyanine complexes suitable for use in the process of this invention exhibit surprisingly excellent photodynamic effects, although this characteristic was not to be expected from the nature of the central atom. Whereas, for example, zinc complexes are known to cause photocatalytic reactions, these reactions are not really to be expected of aluminium complexes. Moreover, compared with the corresponding sulphonated zinc phthalocyanines (cf. U.S. Pat. No. 3,927,967), the water-soluble aluminium phthalocyanine complexes used in the present invention exhibit a higher light stability in solution as well as better lightfastness properties on the fabric, whereby substantially smaller amounts of photoactivators can be used for a given degree of bleaching. Furthermore, depending on the substitution, it is possible to obtain high degrees of exhaustion onto the respective fabric. Finally, from the ecological point of view, the use of aluminium complexes is for known reasons to be preferred to that of zinc complexes (cf. Chemie in unserer Zeit 4 [1973], 97-105).

Even if the use of water-soluble aluminium phthalocyanines yields the best results, the process of the invention can also be carried out if, instead of the aluminium complexes, calcium, magnesium or iron(II) complexes are used. Although good stain removal is also obtained with these latter, compared with the aluminium complexes they have the drawback of being less stable in aqueous solutions and under irradiation by light. In principle, however, the complexes of the above three metals can be used in the process of the present invention as photoactivators with substituted phthalocyanine derivatives described above.

The corresponding alkali metal complexes also have a stain-removing action, but are of less practical importance on account of their being less stable in solution.

The bleaching process of the present invention, i.e., the treatment of textiles with the photoactivator, is preferably carried out in a neutral or alkaline pH range.

The water-soluble phthalocyanines are advantageously used in amounts of 0.01 to 100, especially 0.1 to 50, mg/l of the treatment bath. The amount can vary greatly with the substitution of the phthalocyanines.

The process is preferably carried out as a combined washing and bleaching process, in which case the aqueous bath also contains an organic detergent, such as soap or a synthetic detergent (see below), and can also contain other detergent aids, such as soil suspending agents, for example sodium carboxymethyl cellulose, and fluorescent brightening agents. The photoactivator can therefore either be already incorporated in the corresponding detergent or can be added subsequently to the wash liquor. However, the process can also be carried out as a pure stain-removing process without detergent aids. In this case, it is advantageous if the treatment bath contains an electrolyte, for example sodium chloride, sodium sulphate or sodium tripolyphosphate, in order to ensure the exhaustion of the water-soluble aluminium phthalocyanine dye. The amounts of electrolyte can be about 5 to 20 g/l.

The stain-removing process is advantageously carried out at temperatures in the range between about 20° and 100°, especially 20° and 85° C., over a period of 15 minutes to 5 hours, preferably 15 minutes to 60 minutes.

The presence of oxygen and irradiation with light in the visible and/or infra-red range is necessary for the stain-removing process of the invention. The oxygen dissolved in water or atmospheric oxygen suffices as oxygen source.

The irradiation can be effected with an artificial light source which affords light in the visible and/or infra-red range (e.g. incandescent lamp, infra-red lamp), and the bleach or washing bath can be irradiated direct, whether by means of a light source inside the receptacle containing the liquor (e.g. lamp in the washing machine) or by a light source outside the receptacle. Likewise, the irradiation can be effected only when the textiles are removed from the treatment bath. In this case, the textiles should however still be moist and, if not, they must subsequently be moistened again. Sunlight can also serve as light source, in which case the textiles are preferably exposed to sunlight in the moist state after the treatment in the washing or bleach bath.

Although it is not possible to be bound by theory, it is nonetheless assumed that the mechanism of the stain-removing process takes the following course: first the photoactivator (sens) absorbs light to raise it to the triplet state $$^1\text{sens} + h\nu \rightarrow {}^3\text{sens}.$$

This reacts with triplet oxygen to form singlet oxygen $$^3O_2 + {}^3\text{sens} \rightarrow {}^1O_2 + {}^1\text{sens}$$

The singlet oxygen oxidises the stain to form colourless or water-soluble oxidation products $$^1O_2 + \text{stain} \rightarrow \text{stain } O_2.$$

Such a theory is suggested for the photoactivated oxidation of organic compounds by Foote and Wexler, J.A.C.S. 86, 3880 (1964).

The present invention also provides a detergent composition which is suitable for use in the process and which contains the customary ingredients of detergent and cleansing compositions, at least one builder salt and a photoactivator selected from the above mentioned group.

Suitable detergents are the known mixtures of active detergents, for example soap in the form of chips and powders, synthetics, soluble salts of sulphonic acid hemiesters of higher fatty alcohols, arylsulphonic acids with higher and/or multiple alkyl substituents, sulphocarboxylic acid esters of medium to higher alcohols, fatty acid acylaminoalkyl- or acylaminoaryl-glycerol sulphonates and phosphoric acid esters of fatty alcohols. Suitable builders which can be used are, for example, alkali metal polyphosphates and polymetaphosphates, alkali metal pyrophosphates, alkali metal salts of carboxymethylcellulose and other soil redeposition inhibitors, and also alkali metal silicates, alkali metal carbonates, alkali metal borates, alkali metal perborates, nitrilotriacetic acid, ethylenediaminetetraacetic acid, and foam stabilisers, such as alkanolamides of higher fatty acids. The detergents can further contain for example: antistatic agents, fat restorative skin protectives, such as lanolin, enzymes, antimicrobial agents, perfumes and optical brighteners.

The detergent compositions of the present invention contain the photoactivator preferably in an amount of 0.0005 to 1.25 percent by weight of the total composition. The preferred photoactivator is a sulphonated aluminium phthalocyanine, for example one having a degree of sulphonation of 1.5 to 4, especially 1.5 to 3.

The phthalocyanine compounds used in the process of the present invention can be prepared by methods which are known per se in phthalocyanine chemistry.

To introduce water-solubilising substituents, a start can be made from unsubstituted phthalocyanine or its metal complexes. Sulphonation (e.g. with 26% oleum) results in the corresponding sulphonic acids, whereupon, depending on the duration of the sulphonation and on the temperature, products having a different degree of sulphonation are formed. Sulphonation of unsubstituted phthalocyanine yields for example at 45° to 60° C. disulphonic acid. The conversion into salts can be accomplished in known manner.

Reaction of unsubstituted metal-free or metallised phthalocyanines with chlorosulphonic acid yields the corresponding sulphochloride compounds. Reaction of the resulting sulphochloride-phthalocyanines with correspondingly substituted aliphatic or aromatic amines or alcohols or phenols yields the phthalocyanines substituted by sulphonamide or sulphonic acid ester groups of the formulae (1), (1*a*), (5), (6) or (8, m=1). Saponification of the sulphochloride compounds yields the corresponding sulphonic acids.

Carboxyl groups can be introduced into the unsubstituted phthalocyanines by reaction with phosgene and aluminium chloride and hydrolysis of the resulting acid chloride or by reaction with trichloroacetic acid. The acid chlorides can also be converted in known manner into other water-soluble carboxylic acid derivatives. Mixed substituted products (sulpho and carboxyl groups) can be obtained by a suitable combination of the described processes. Phalocyanines substituted by carboxyl groups can also be prepared by synthesis from trimetallitic acid.

Phthalocyanines which are substituted by groups of the formulae (2), (7) or (9), can be obtained by chloromethylation of unsubstituted metalfree or metallised phthalocyanines, for example by reaction with paraformaldehyde or bis-chloromethyl ether and anhydrous aluminium chloride in the presence of triethylamine, and subsequent reaction of the chloromethyl compounds with correspondingly substituted anilines, phenols or thiophenols or amines, alcohols or mercaptans. The reaction of the above chloromethyl intermediates with pyridine, 1,4-diazabicyclo-[2,2,2]octane or with correspondingly unsubstituted or substituted tetraalkylthioureas yields phthalocyanines which are substituted by groups of the formulae (10, m=1), (10*a*) and (12, m=1). The above chloromethyl compounds can also be reacted with substituted or unsubstituted alkylsulphides to give the corresponding alkylthiomethyl compounds, and the latter with strong alkylating agents to give phthalocyanines which contain ternary groups of the formula (11, m=1).

Phthalocyanines which contain groups of the formulae (10, 11 or 12, m=0), can be prepared from the corresponding chlorine-substituted phthalocyanines which are obtainable by direct chlorination of the unsubstituted phthalocyanines by the methods described for the reaction of chloromethyl compounds. Phthalocyanines which are substituted by water-solubilising groups of the formulae (3) or (8, m=0) can also be obtained for example by starting from correspondingly substituted phthalic anhydride or phthalodinitrile and reacting this latter compound to give the phthalocyanine ring system. When using substituted phthalodinitrile, this compound, optionally together with a metal salt, is fused or cyclised in solution or suspension to give the phthalocyanine ring system. When using the corresponding phthalic anhydride, urea and, if appropriate, a catalyst, for example boric acid or ammonium molybdate, is additionally added before the reaction. Other substituted phthalocyanines, for example the sulphonated phthalocyanines, can also be obtained in this manner.

If the above described substitution reactions are not carried out direct with the aluminium phthalocyanine complex, or the syntheses of the phthalocyanine ring system are not carried out in the presence of an aluminium compound, a correspondingly substituted metal-free phthalocyanine can be reacted subsequently with an aluminium salt or aluminium alcoholate in a solvent. Suitable solvents are for example mixtures of water and organic solvents, especially also tertiary amines or also anhydrous organic solvents, for example pyridine or chlorobenzenes. This mode of manufacture is also especially advantageous for more easily hydrolysable complexes, such as the alkali metal, alkaline earth metal and iron(II) complexes.

It will be understood that the correspondingly substituted aluminium phthalocyanine complexes can also be obtained from other metal complexes by substituting aluminium for the respective metal.

In the following Examples, which illustrate the manufacture of the photoactivators of the present invention as well as the process of the invention itself, all percentages are by weight. In all Examples, the abbreviation PC denotes the unsubstituted phthalocyanine.

EXAMPLE 1

2.66 g of aluminium chloride are added to a solution of 6.76 g of phthalocyanine-disulphonic acid having an absorption maximum of 612 nm in a buffer solution of pH 7 (0.01 mole/l of sodium hydrogen phosphate/0.007 mole/l of potassium hydrogen phosphate) in 500 ml of a 1:1 mixture of pyridine/water. The solution is refluxed for 2 hours and then concentrated by rotary evaporation. The residue is taken up in 75 ml of water and the solution neutralised with ammonia, yielding the disulphonated aluminium phthalocyanine with an absorption maximum of 675 nm (buffer solution of pH 7).

The corresponding phthalocyanines listed in Table 1 are obtained by repeating the procedure described in this Example, but using salts of other metals.

Table 1

| metal salt | Phthalocyanine derivative | λ max. in $H_2O$, pH9 (nm) |
|---|---|---|
| $Mg\ Cl_2$ | $Mg\ (PC)(SO_3H)_2$ | 669 |
| $Ca\ Cl_2$ | $Ca\ (PC)(SO_3H)_2$ | 653 |
| $Fe\ SO_4$ | $Fe\ (PC)(SO_3H)_2$ | 662 |

EXAMPLE 2

(a) 52.5 g of phthalic anhydride, 64 g of urea, 1 g of ammonium molybdate, 27 g of sodium m-xylenesulphonate are stirred in 175 g of trichlorobenzene and mixed with a suspension of 15 g of anhydrous aluminium chloride in 25 g of trichlorobenzene. After stirring for 6 hours at 200° to 205° C., 27 g of urea and 50 g of trichlorobenzene are added and stirring is continued for a further 5 hours at the same temperature. The suspension is filtered cold and the residue is washed with chlorobenzene and with methanol and then purified by extraction by boiling in dilute hydrochloric acid, dilute sodium hydroxide solution and again in dilute hydrochloric acid, then dired, affording 34 g of an aluminium phthalocyanine whose analysis corresponds to the formula $$C_{32}H_{16}N_8AlCl.2\ H_2O.$$

(b) 20 g of this aluminium phthalocyanine are stirred in 220 ml of 30% oleum for 8 hours at 73°-75° C. After cooling to room temperature, the resulting solution is poured onto ice and 10% sodium chloride solution. The suspension is filtered and the residue is washed with a 10% sodium chloride solution and 1 N hydrochloric acid and dried in vacuo at 90° C.

Yield: 22 g. The product has the formula $$AlCl(PC)(SO_3H)_2 \qquad (201)$$

λmax=671 nm (in $H_2O$, pH 9).

In (a), it is also possible to use any other aluminium salt instead of aluminium chloride. Depending on the nature of the anion, in this Example and in those which follow, aluminium phthalocyanine derivatives are obtained in which the third valency of aluminium is saturated with any other anion (e.g. sulphate, acetate, hydroxyl etc.) instead of with chlorine.

EXAMPLE 3

(a) 20 g of the aluminium phthalocyanine prepared in accordance with Example 2(a) are added to 140 ml of chlorosulphonic acid at 20°-25° C. and the mixture is stirred for 30 minutes. The temperature is then raised to 135°-140° C. in the course of 2 hours. After stirring for 4 hours, the reaction mixture is cooled to room temperature and poured onto ice. The suspension is filtered and the residue is washed free of acid with ice-water.

(b) The moist filter cake is stirred in 500 ml of ice-water and then 3.2 g of ethanolamine are added. With stirring, the pH is kept at 8 to 9 by addition of 10% sodium hydroxide solution. After stirring for 2 hours at 0° to 25° C., the temperature is raised to 60°-70° C. and kept thereat for 5 hours. The product is precipitated completely by addition of sodium chloride, collected by filtration and dried in vacuo at 70° to 80° C. The resulting compound has the formula $$Al\ Cl\ (PC)\begin{cases}(SO_3H)_{2,5}\\(SO_2NHCH_2CH_2OH)_{1,5}\end{cases} \qquad (301)$$

λmax=677,5 nm (in $H_2O$, pH 7).

The compounds of the general formula $$Al\ Cl\ (PC)\begin{cases}(SO_3H)_{4-x}\\(SO_2{-}R)_x\end{cases} \qquad (302)$$

listed in Table 2 are obtained by reacting the aluminium phthalocyanine tetrasulphochloride obtained by the procedure of Example 3(a) in analogous manner with other amines.

Table 2

| Formula | R | x | Amine |
|---|---|---|---|
| 303 | $-NH_2$ | 1 | $NH_4OH$ |
| 304 | $-NHCH_3$ | 1 | $H_2NCH_3$ |
| 305 | $-N(CH_2CH_2OH)_2$ | 1.5 | $HN(CH_2CH_2OH)_2$ |
| 306 | $-NHCH_2CH_2N(CH_3)_2$ | 3 | $H_2NCH_2CH_2N(CH_3)_2$ |
| 307 | $-NHCH_2CH_2CH_2N(CH_3)_2$ | 4 | $H_2NCH_2CH_2CH_2N(CH_3)_2$ |
| 308 | $-N(CH_3)CH_2CH_2SO_3H$ | 2 | $HN(CH_3)CH_2CH_2SO_3H$ |
| 309 | $-NHCH_2CH_2OSO_3H$ | 2 | $H_2NCH_2CH_2OSO_3H$ |
| 310 | $-NH(CH_2)_6COOH$ | 1 | $H_2N(CH_2)_6COOH$ |
| 311 | 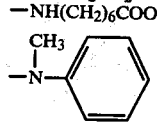 | 1 | 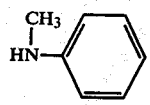 |
| 312 | 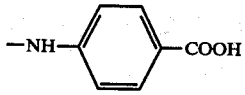 | 1.5 | 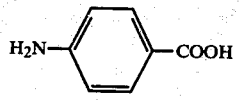 |
| 313 | 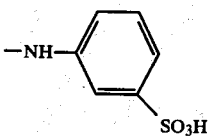 | 1 | 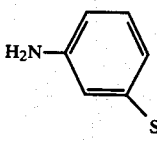 |
| 314 | 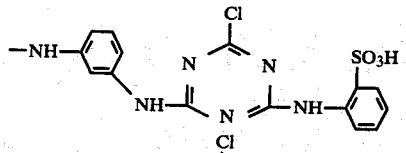 | 1 | 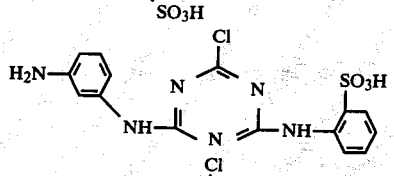 |
| 315 | 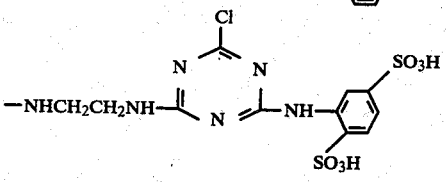 | 2 | 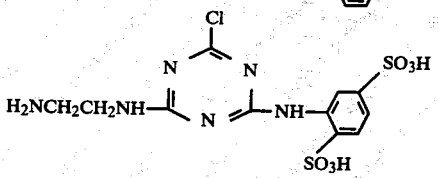 |
| 316 | 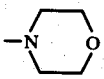 | 1 | 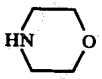 |

EXAMPLE 4

20 g of the aluminium phthalocyanine tetrasulphochloride obtained by the procedure of Example 3(a) are added to 500 ml of water and hydrolysed by addition of sodium hydroxide solution at 60°–70° C. After concentrating to dryness, 25 g of aluminium phthalocyanine tetrasulphonic acid (sodium salt) of the formula $$AlCl(PC)\text{-}(SO_3Na)_4 \qquad (401)$$

$\lambda max = 672{,}75$ nm (in $H_2O$, pH 9).

are obtained.

The same compound can also be obtained by sulphonation of the unsubstituted aluminium phthalocyanine (obtainable by the procedure of Example 2(a) with 60% oleum at 70°–75° C.

EXAMPLE 5

(a) 20 g of the aluminium phthalocyanine prepared by the procedure of Example 2(a) are added at 25° C. to 150 ml of chlorosulphonic acid and the mixture is stirred for 30 minutes. The reaction mixture is then heated to 65°–70° C. and 32 ml of thionyl chloride are added dropwise in the course of 20 minutes. The temperature is subsequently raised to 110°–115° C. in the course of 2 hours and kept thereat for 6 hours. After cooling to 25° C., the reaction mass is poured onto ice such that the temperature does not rise above 0° C. in doing so. The suspension is filtered and the residue is washed free of acid with ice-water.

(b) The moist filter cake, consisting of aluminium phthalocyanine trisulphochloride, is stirred in 500 ml of ice-water and then 32 g of 1-amino-3-dimethylaminopropane are added. After stirring for 15 hours at 20°–30° C., the temperature is raised for a further 4 hours to 60°–70° C. The suspension is filtered, and the residue is washed with warm water and dried in vacuo at 70°–80° C., affording the compound of the formula $$AlCl(PC)\text{-}[SO_2NHCH_2CH_2CH_2N(CH_3)_2]_3 \qquad (501)$$

$\lambda max = 675{,}5$ nm (in $H_2O$, pH 7).

In analogous manner, the compounds of the formula $$AlCl(PC)\text{-}[SO_2\text{—}R]_3 \qquad (502)$$

listed in Table 3 can be obtained by reaction of aluminium trisulphochloride, obtained by the procedure of Example 5(a), with a corresponding amine.

| Formula | R | Starting compound HR |
|---|---|---|
| 503 | $-NH-CH_2CH_2-N(CH_3)_2$ | $H_2N-CH_2CH_2-N(CH_3)_2$ |

-continued

| Formula | R | Starting compound HR |
|---|---|---|
| 504 | 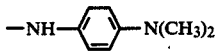 | 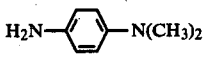 |

EXAMPLE 6

20 g of the aluminium phthalocyanine prepared by the procedure of Example 2(a) are added at 25° C. to 220 ml of 25% oleum and the mixture is stirred for 7 hours at 40° C. After stirring for a further 12 hours at room temperature, the mass is poured into a mixture of ice/sodium chloride, filtered and washed with 500 ml of 5% hydrochloric acid. The filter residue is dried in vacuo at 70° C.

The product has the formula $$AlCl(PC)\text{-}(SO_3H)_{1,4} \quad (601)$$

$\lambda max = 676$ nm (in $H_2O$, pH 10).

EXAMPLE 7

20 g of the aluminium phthalocyanine obtained by the procedure of Example 2(a) are stirred in 240 ml of 33% oleum for 7 hours at 73°–75° C. The reaction mixture, which has been cooled to 25° C., is charged into a mixture of 1000 g of ice and 200 g of sodium chloride. The temperature is kept at 0° to 20° by further addition of ice. The suspension is filtered and the filter residue is washed neutral with a 10% sodium chloride solution, then with 300 ml of 10% hydrochloric acid. The product is dried at 80° C. in vacuo. The resulting product has the formula $$AlCl(PC)\text{-}(SO_3H)_3 \quad (701)$$

$\lambda max = 671$ nm (in $H_2O$, pH 9).

Carrying out the above sulphonation with 40% oleum yields a product of the formula $$AlCl(PC)\text{-}(SO_3H)_{<4} \quad (702)$$

$\lambda max = 671{,}75$ (in $H_2O$, pH 9).

EXAMPLE 8

A cotton fabric weighing 1 g and stained with tea (*) is treated at 55° C. under irradiation with a 200 watt incandescent lamp (**) for 1 hour with stirring in 200 ml of an aqueous wash liquor which contains 0.75 ppm of aluminium phthalocyanine-disulphonic acid (prepared in accordance with Example 1) and 1 g of a detergent of the following composition:

| | |
|---|---|
| sodium dodecylbenzenesulphonate | 16% |
| sodium tripolyphosphate | 43% |
| sodium silicate | 4% |
| magnesium silicate | 2% |
| fatty alcohol sulphonate | 4% |
| sodium carboxymethyl cellulose | 1% |
| sodium salt of ethylenediamine-tetraacetic acid | 0.5% |
| sodium sulphate | 29.5% |

The degree of stain removal is measured with a Zeiss Elrepho ®-Photometer (standard illuminant D65, 2 degree normal viewer, measuring diaphragm 35 mm $\phi$) in the form of brightness values, expressed in %, based on the absolute whiteness in accordance with the C.I.E. recommendation of 1.1.1969. The values obtained are reported in Table 4.

Table 4

| | Degree of stain removal (=brightness value, in %) |
|---|---|
| tea-stained cotton | 51.4 |
| stain removal wash with $AlCl(PC)(SO_3H)_2$ | 77.9 |

(*) The staining of the cotton sample is carried out as follows: 15 g of tea ("Fine Ceylon Fannings Tea") are boiled for 1 hour in 600 ml of desalinated water and then filtered. The filtered tea leaves are taken up in 400 ml of desalinated water and boiled again for 60 minutes. Both filtrates are combined and made up to 1000 ml with desalinated water. With constant agitation, 45 g of cotton fabric (bleached and washed) are treated at 100° C. for 2½ hours, then "staining" is effected in a cooled bath for a further 16 hours. Then 5 g of sodium chloride are added to the tea liquor and treatment is carried out again for 2½ hours at 100° C. Finally, the liquor is cooled and the stained cotton is rinsed twice at 60° C. and dried at 100° C. Finally, the stained fabric is washed with a liquor containing 5 g/l of detergent (composition, see above), washed for 20 minutes at 90° C. (liquor ratio 1:20), rinsed warm and cold and dried at 100° C. in a forced draught oven. (**) Lamp: "Luxram" incandescent lamp of 220/230 volts, 200 watts, E 27, frosted. The lamp is mounted about 10 cm above the wash liquor. Measured light intensity: 19,000 lux.

EXAMPLE 9

A cotton sample, weighing 1 g and coloured with a brown dye(*), is treated at 55° C. under irradiation with an infra-red lamp(**) for ½ hour, with stirring, with 200 ml of an aqueous liquor containing 2 g of sodium chloride, 0.06 g of sodium hydroxide and 1 ppm of aluminium phthalocyanine-disulphonic acid. For comparison purposes, a similar cotton sample is treated with a liquor of the same composition which contains, instead of 1 ppm of aluminium phthalocyanine-disulphonic acid, the same amount of zinc phthalocyanine-disulphonic acid.

After the treatment, the samples are rinsed and dried. The amount of brown dye adhering to the respective fabric samples and of the phthalocyanine compound is determined colorimetrically (results in percent by weight, based on the weight of the sample, see Table 5).

Table 5

| | Brown dye (%) | Phthalocyanine compound (%) |
|---|---|---|
| unbleached | 0.139 | — |
| bleached with $AlCl(PC)(SO_3H)_2$ | 0.021 | 0.0037 |
| bleached with $Zn(PC)(SO_3H)_2$ | 0.02 | decomposed |

It follows from the measurements that $AlCl(PC)(SO_3H)_2$ is decomposed less rapidly by the irradiation that $Zn(PC)(SO_3H)_2$.

(*) The dyeing of the cotton sample is carried out as follows: 150 mg of the commercially available brown dye of the formula

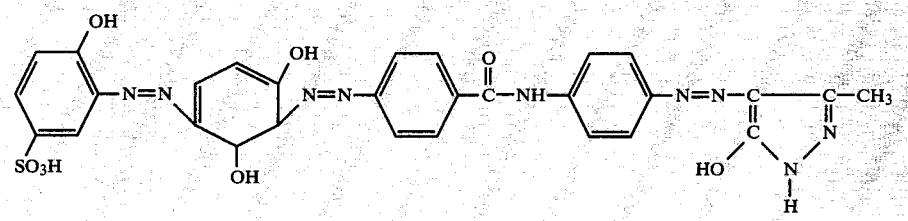

are dissolved in 2000 ml of water which contains 1 g of sodium carbonate at a temperature of 50° C. Bleached, mercerised cotton fabric (100 g) is dyed in this dye liquor, with constant agitation, by heating the bath for 30 minutes to 90° C. Dyeing is carried out for 90 minutes, in the course of which time 20 g of Glauber's salt are added in 4 portions of equal size at intervals of 15 minutes.

When the dyeing is complete, the fabric is rinsed cold twice and coppered for 20 minutes at 60° C. in a liquor ratio of 1:20 in a bath containing 0.75 g/l of copper sulphate crystals and 1 ml/l of glacial acetic acid. The dyeing is subsequently rinsed cold twice and dried in a hot-air oven at 100° C.

(**) Lamp: "Phillips" infra-red lamp (white), 220/230 volts, 250 watt with reflector, type 13372 E/06. The lamp is mounted about 10 cm above the liquor. Measured light intensity: 85,000 lux.

EXAMPLE 10

10 g of a cotton sample dyed in accordance with Example 9 with a brown dye are put into 200 ml of water in which 0.75 mg of aluminium phthalocyanine-disulphonic acid and 0.2 g of sodium tripolyphosphate are dissolved. With constant agitation, the liquor is heated to 75° C. and kept for 90 minutes at this temperature, while 4 g of Glauber's salt are added in 4 portions of equal size at 10 minute intervals. Afterwards the fabric sample is rinsed cold briefly and dried in a forced draught oven at 100° C. All previously described operations are carried out with the substantial exclusion of light.

For comparison purposes, a similar fabric sample is treated, using 1.2 mg of zinc phthalocyanine-disulphonic acid instead of 0.75 mg of aluminium phthalocyanine-disulphonic acid.

The coloured samples are then moistened with a buffer solution of pH 10 (composition: 0.03 mole/l of disodium tetraborate and 0.042 mole/l of sodium hydroxide) and exposed at room temperature under an overhead projector (portable projector, Model 088/88 BH, available from 3M, with a lamp of type 78-8454/3480, General Electric, 240 volts, 480 watt).

The samples are under a glass plate at a spacing of 30 cm beneath the lamp. For control purposes, a piece of fabric dyed brown is also exposed in the same way without treatment with phthalocyanines.

To determine the brown dye decomposed during the exposure and the amount of phthalocyanine compounds remaining on the fabric, the samples are evaluated colorimetrically against standard dyeings. The values obtained are reported in Table 6 (in percent by weight of dye, based on the weight of the fabric).

Table 6

| Expose time / Dyeing | Brown dye alone in (%) | Brown dye treated with $Zn(PC)(SO_3H)_2$ in (%) | Brown dye treated with $AlCl(PC)(SO_3H)_2$ in (%) | Amount of $Zn(PC)(SO_3H)_2$ in (%) | Amount of $AlCl(PC)(SO_3H)_2$ in (%) |
|---|---|---|---|---|---|
| before exposure | 0.1519 | 0.1294 | 0.1291 | 0.0115 | 0.007 |
| 30 min. exposure (%age of initial amount) | | 0.0298 (23.03%) | 0.0345 (26.72%) | 0.0053 (46.08%) | 0.0066 (94.29%) |
| 60 min. exposure (%age of initial amount) | 0.1263 (83.15%) | 0.0218 (16.85%) | 0.0186 (14.41%) | 0.0039 (33.91%) | 0.0062 (88.57%) |
| 120 min. exposure (%age of initial amount) | | 0.0195 (15.07%) | 0.0137 (10.61%) | 0.0034 (29.57%) | 0.0059 (84.29%) |
| 150 min. exposure (%age of initial amount) | 0.1199 (78.94%) | 0.0141 (10.90%) | 0.012 (9.30%) | 0.0030 (26.00%) | 0.0056 (80%) |

The percentages in brackets refer to respective initial amounts before the exposure.

Cotton fabric stained with tea can also be bleached with equally good success by the process described in Example 10.

EXAMPLE 11

Pieces of cotton fabric dyed with brown dye in accordance with Example 9 are washed at 55° C. for 60 minutes (liquor ratio 1:200), with stirring and under irradiation with a 200 watt standard incandescent lamp mounted at a distance of about 10 cm from the surface of the wash liquor, in a wash liquor containing 2.5 g/l of sodium carbonate, 2.5 g/l of a detergent of the composition indicated in Example 8 and the respective amount of a water-soluble aluminium phthalocyanine given in Table 7. After washing, the fabric is rinsed, dried, and its brightness value determined in the same way as indicated in Example 8. The brightness values (in %) are also reported in Table 7.

Table 7

| Water-soluble aluminium phthalocyanine of the formula | amount added (in ppm, based on the weight of the fabric) | brightness value (%) |
|---|---|---|
| 201 | 0.75 | 78.1 |
| 301 | 0.75 | 75.5 |
| 401 | 7.5 | 73.1 |

Table 7-continued

| Water-soluble aluminium phthalocyanine of the formula | amount added (in ppm, based on the weight of the fabric) | brightness value (%) |
|---|---|---|
| 501 | 0.5 | 73.1 |
| 601 | 0.5 | 75.3 |
| 701 | 1.25 | 78.5 |
| 702 | 5.0 | 78.6 |
| Test fabric washed without photoactivator (brown colouration) | — | 53.3 |

Similarly good results are obtained with the compounds of the formulae (303) to (316) and (503) and (504).

EXAMPLE 12

In the same way as described in Example 11, the stain removal action of the water-soluble aluminium phthalocyanine derivatives of the general formula $$AlCl(PC\text{-})[CH_2\text{-}R_x]_v \qquad (1201)$$

listed in Table 8 is also tested.

Table 8

| Formula | $R_x$ | v |
|---|---|---|
| 1202 | $-\overset{\oplus}{N}(CH_3)_3\ Cl^{\ominus}$ | 3 |
| 1203 | $-\overset{CH_3\oplus}{\underset{CH_3}{N}}-NH_2\ Cl^{\ominus}$ | 3 |
| 1204 | 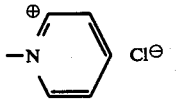 | 3 |
| 1205 | $-S-C(=NH_2^{\oplus})(NH_2)\ Cl^{\ominus}$ | 2 |
| 1206 | $-\overset{\oplus}{S}=C(N(CH_3)_2)_2\ Cl^{\ominus}$ | 3 |
| 1207 | 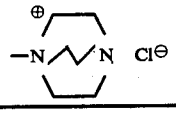 | 3 |

The compounds listed in Table 8 also effect a very good stain removal action.

The sulphonated calcium, magnesium and iron(II) phthalocyanines obtained according to Example 1 are also investigated for their stain-removal action by the method of Example 11 and exhibit likewise useful effects.

What is claimed is:

1. A process for bleaching textiles with photoactive compounds, which comprises treating stained textiles in an aqueous bath containing at least one photoactivator selected from the class of the water-soluble aluminum phthalocyanines, under irradiation with visible and/or infra-red light and in the presence of oxygen, while either irradiating the bleaching bath direct or subsequently irradiating the moist textiles outside the bath.

2. A process as claimed in claim 1, wherein the photoactivator is an aluminum phthalocyanine which is substituted by one or more water-solubilising groups selected from the group consisting of sulpho and carboxyl groups and the salts thereof, and groups of the formulae

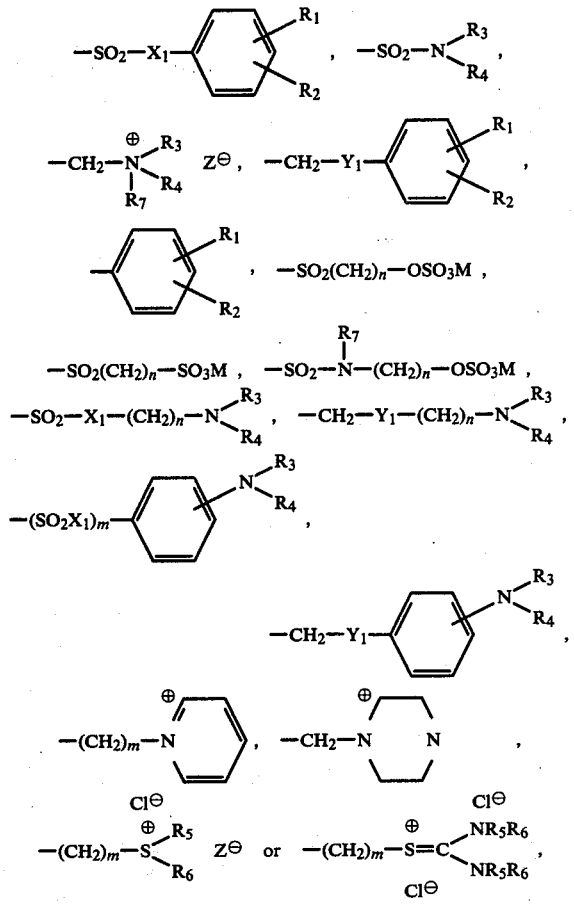

wherein $X_1$ represents oxygen, the radical —NH— or —N-alkyl, and $R_1$ and $R_2$, each independently of the other, represent hydrogen, the sulpho group and the salts thereof, the carboxyl group and the salts thereof or the hydroxyl group, whilst at least one of the symbols $R_1$ and $R_2$ represents a sulpho or carboxyl group or the salts thereof, $Y_1$—represents oxygen, sulphur, the radical —NH— or —N-alkyl, $R_3$ and $R_4$, each independently of the other, represent hydrogen, alkyl, hydroxyalkyl, cyanoalkyl, sulphoalkyl, carboxyalkyl or halogenalkyl, each containing 1 to 6 carbon atoms, phenyl which is unsubstituted or substituted by halogen, alkyl or alkoxy of 1 to 4 carbon atoms, sulpho or carboxyl, or $R_3$ and $R_4$ together with the nitrogen atom to which they are attached form a saturated 5- or 6-membered heterocyclic ring which can additionally contain a further nitrogen or oxygen atom as ring member, $R_5$ and $R_6$, each independently of the other, represent a substituted or unsubstituted alkyl or aralkyl radical, $R_7$—represents a substituted or unsubstituted alkyl group of 1 to 6 carbon atoms or hydrogen, M—represents an alkali metal or ammonium ion, $Z^{\ominus}$—represents an anion selected from the group consisting of chloride, bromide, alkylsulphate and arylsulphate ions, n—is an integer from 2 to 12, and m—is 0 or 1, and, in addition to the water-solubilising groups, zero or more substituents selected from the group consisting of chlorotriazine, chloropyrazine and chloropyrimidine radicals.

3. A process as claimed in claim 2, wherein the photoactivator is a water-soluble aluminum phthalocyanine of the formula $$AlX(PC—(R)_v$$

wherein

PC—represents the phthalocyanine ring system, v—has any value between 1 and 4,

X—represents an anion, preferably a halide, sulphate, nitrate, acetate or hydroxyl ion, and R—represents a group of the formula

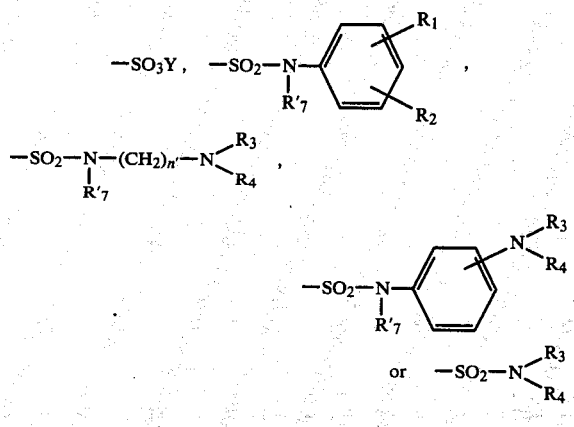

wherein

Y—represents hydrogen, an alkali metal, ammonium or amine ion, $R_7'$—represents hydrogen or alkyl of 1 to 4 carbon atoms, n'—is an integer from 2 to 6, $R_1$ and $R_2$, each independently of the other, represent hydrogen, the sulpho group and the salts thereof, the carboxyl group and the salts thereof, whilst at least one of the symbols $R_1$ and $R_2$ represents a sulpho or carboxyl group or the salts thereof, and $R_3$ and $R_4$, each independently of the other, represent hydrogen, alkyl, hydroxyalkyl, cyanoalkyl, sulphoalkyl, carboxyalkyl or halogenalkyl, each containing 1 to 6 carbon atoms, or phenyl, or $R_3$ and $R_4$ together with the nitrogen atom to which they are attached form a saturated 5- or 6-membered heterocyclic ring which additionally can also contain a further nitrogen or oxygen atom as ring member, with the proviso that, if several radicals R are present in the molecule, these radicals can be the same or different and all radicals R are bonded to the phenyl nuclei of the phthalocyanine ring system.

4. A process as claimed in claim 3 which comprises the use of an aluminum phthalocyanine of the formula

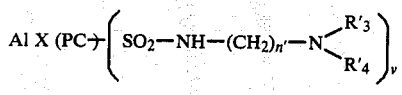

wherein

PC and X are as defined in claim 3, n' is an integer between 2 and 6, $R_3'$ and $R_4'$, each independently of the other, represent hydrogen, alkyl, hydroxyalkyl, cyanoalkyl or halogenalkyl, each containing 1 to 6 carbon atoms, and v is an integer between 1 and 4, with the proviso that, if v is greater than 1, the radicals

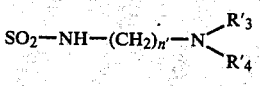

present in the molecule can be the same or different.

5. A process as claimed in claim 3 which comprises the use of a sulphonated aluminum phthalocyanine as water-soluble phthalocyanine.

6. A process as claimed in claim 5 which comprises the use of a sulphonated aluminum phthalocyanine of the formula $$AlX(PC\text{+}(SO_3Y')_{v'}$$

wherein

PC—represents the phthalocyanine ring system,

X—represents an anion selected from the group consisting of halide, sulphate, hydroxyl and acetate ions, Y'—represents hydrogen, an alkali metal or ammonium ion, and v'—represents any number between 1.3 and 4 (degree of sulphonation).

7. A process as claimed in claim 6 which comprises the use of a sulphonated aluminum phthalocyanine having a degree of sulphonation of 1.5 to 2.5.

8. A process as claimed in claim 6 which comprises the use of a sulphonated aluminum phthalocyanine having a degree of sulphonation of 2.5 to 4.

9. A process as claimed in claim 3 which comprises the use of a water-soluble phthalocyanine of the formula

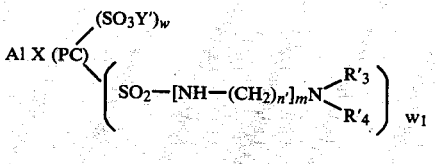

wherein

PC and X are as defined in claim 3,

Y'—represents hydrogen, an alkali metal or ammonium ion, n'—is an integer between 2 and 6, $R_3'$ and $R_4'$, each independently of the other, represent hydrogen, phenyl, sulphophenyl, carboxyphenyl, alkyl, hydroxyalkyl, cyanoalkyl, sulphoalkyl, carboxyalkyl or halogenalkyl, each alkyl radical containing 1 to 6 carbon atoms, or $R_3'$ and $R_4'$ together with the nitrogen atom to which they are attached form the morpholine ring, m—is 0 or 1, and w and $w_1$, each independently of the other, is any number between 0.5 and 3, whilst $w+w_1$ is at least 1, but not more than 4.

10. A process as claimed in claim 1, wherein the aqueous bath contains an electrolyte in addition to the photoactivator.

11. A process as claimed in claim 10, wherein sodium chloride, sodium sulphate or sodium tripolyphosphate is used as electrolyte.

12. A process as claimed in claim 1 which comprises the use of an aqueous bath which also contains an organic detergent and, if desired, other conventional detergent ingredients.

13. A process as claimed in claim 1, wherein the photoactivator is present in a concentration of 0.1 to 50 mg/l of the bath.

14. A process as claimed in claim 1, wherein the irradiation is carried out with an artificial light source, preferably an incandescent lamp or infra-red lamp, either in the bleaching bath or outside the bleaching bath.

15. A process as claimed in claim 1, wherein the textiles are irradiated in sunlight.

16. A process as claimed in claims 1, 14 and 15, wherein the intensity of the visible light is at least 1000 lumen.

17. A process as claimed in claim 16, wherein the textiles are treated at a temperature between 10° and 85° C.

18. A process as claimed in claim 5, which comprises treating the textiles in an aqueous bath containing the phthalocyanine compound, removing the textiles from the bath and then, when they are still moist or have been moistened again after drying, irradiating the textiles with a suitable source of artifical light or exposing them to sunlight.

19. A detergent composition containing an organic detergent, an alkaline builder salt and a photoactivator selected from the class of the water-soluble aluminum phthalocyanines.

20. A detergent composition as claimed in claim 19, which contains 0.0005 to 1.5 percent by weight of photoactivator, based on the entire composition.

21. A detergent composition containing an organic detergent, an alkaline builder salt and 0.0005 to 1.5 percent by weight of a water-soluble aluminum phthalocyanine photoactivator of claim 3.

22. A detergent composition as claimed in claim 20, which contains sulphonated aluminum phthalocyanine as photoactivator.

* * * * *

UNITED STATES PATENT AND TRADEMARK OFFICE

CERTIFICATE OF CORRECTION

PATENT NO. : 4,166, 718

DATED : SEPTEMBER 4, 1979

INVENTOR(S) : GERHARD REINERT ET AL

It is certified that error appears in the above-identified patent and that said Letters Patent are hereby corrected as shown below:

Claim 2, column 18, line 35 reads:

" 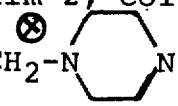 ".

Should read:

" 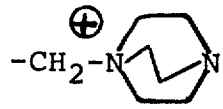 ".

Signed and Sealed this

*Third* Day of *March 1981*

[SEAL]

*Attest:*

RENE D. TEGTMEYER

*Attesting Officer*

*Acting Commissioner of Patents and Trademarks*